United States Patent [19]

Goins et al.

[11] Patent Number: 5,062,354

[45] Date of Patent: Nov. 5, 1991

[54] SIDE WALL VENT/AIR TERMINATION UNIT FOR BOILERS

[75] Inventors: James V. Goins; Robert B. Duggan; William J. Pier, all of Michigan City; Roger Wienhoft, LaPorte, all of Ind.

[73] Assignee: The Marley Company, Mission Woods, Kans.

[21] Appl. No.: 620,566

[22] Filed: Dec. 3, 1990

[51] Int. Cl.[5] ..... F23L 17/04

[52] U.S. Cl. ..... 98/62; 126/85 B; 126/307 A

[58] Field of Search ..... 126/85 B, 307 A; 98/62, 98/64, 48

[56] References Cited

U.S. PATENT DOCUMENTS

| | | | |
|---|---|---|---|
| 3,521,547 | 7/1970 | Hodges | 126/85 B |
| 4,111,004 | 9/1978 | Blomberg | 126/85 B |
| 4,448,112 | 5/1984 | Soderberg | 98/62 |
| 4,690,129 | 9/1987 | Halstead | 126/85 B |

*Primary Examiner*—Edward G. Favors

*Attorney, Agent, or Firm*—Kokjer, Kircher, Bowman & Johnson

[57] ABSTRACT

A side wall termination unit for a gas boiler which terminates side by side vent and air supply pipes extending through a building side wall. The pipes extend through inside and outside plates on the internal and external wall surfaces. A one piece termination cap is mounted on the outside plate and includes a sleeve which holds the vent pipe in alignment with a vent opening in the cap. The intake end of the air supply pipe is butted against stops to keep it exposed. Extending around the sleeve and stops is a wall formed by spaced apart fingers which present between them air intake openings for allowing outside air to enter the intake pipe. A peripheral flange on the termination cap is spaced outwardly from the building wall to provide an air intake slot.

17 Claims, 2 Drawing Sheets

SIDE WALL VENT/AIR TERMINATION UNIT FOR BOILERS

BACKGROUND OF THE INVENTION

This invention relates generally to the venting of exhaust gases and the supply of combustion air for gas fired boilers. More particularly, the invention is directed to a termination unit for terminating separate side by side vent and air supply pipes extending through a side wall of a building which contains the boiler.

The flue gases of a gas fired boiler may be exhausted through the roof, through a chimney or through a side wall of the building containing the boiler. When venting of the combustion gases is through a side wall, it is common practice for air supply piping to be provided in order to furnish outside air to the boiler for the combustion process. Typically, the vent piping and the air supply piping are arranged concentrically.

In a concentric pipe installation, the outside pipe must be rather large in diameter in order to provide both pipes with sufficient size. The need for a large pipe leads to the requirement for a large hole size and also necessitates a large radius for the bends in the piping. A large bend radius requires considerable room to achieve and is particularly disadvantageous where space is a problem such as when floor joints are near the side wall penetration location. Another problem with concentric pipe systems is that an inner plenum in the boiler is required for the transition between the two piping runs. This complicates the boiler construction and increases the cost of the boiler. The materials that can be used for the air pipe are also limited in a concentric pipe arrangement because of the proximity of the air pipe to the vent pipe. Other problems are that special fittings are often required and the length of the piping runs is limited.

The inlet end of the air supply pipe often requires active elements in order to assure an adequate air volume. Additionally, phenomena such as frost and foreign material clogging of the air intake can create problems. Provision must also be made at times for draft problems caused by an overhanging roof or other overhangs. Acidic condensates and other chemical agents in the flue products can corrode and otherwise damage the components of the termination structure unless special materials are used.

SUMMARY OF THE INVENTION

The present invention is directed to a termination unit for terminating spaced apart vent and air pipes at a side wall in an improved manner. Side by side pipe systems are more desirable than concentric systems in many respects, including the reduced bend space that is required for piping turns, the possibility of using longer piping runs, and the feasibility of using inexpensive materials such as PVC, flexible ducting and the like for the air conduit.

In accordance with the invention, inside and outside metal plates are secured to the wall and provided with openings for the vent and air supply pipes. The vent pipe extends through a protective sleeve in the wall and is held away from it by spacer elements. The invention is particularly characterized by a special vent cap which provides for termination of both pipes on the outside surface of the wall. The termination cap may conveniently be injection molded in a single piece and may be made of high temperature plastic resin which is resistant to damage from acidic condensates and other flue products.

The termination cap has a face plate from which a peripheral flange extends. The flange covers the outside mounting plate and has its free edge spaced away from the wall to provide a space for receiving outside air beneath the face plate. The vent pipe fits in a sleeve on the inside of the face plate, and the air supply pipe butts up against stop elements which keep its end exposed to admit air. Extending around the sleeve and the stop elements are a plurality of fingers that are spaced apart to form a perforated wall through which air is drawn into the air pipe to supply combustion air for the boiler.

It is a particular feature of the invention that the spaced fingers are located all around the stop elements and sleeve to assure that some of the air intake openings will remain open even if some are clogged by frost or foreign matter. The location of the vent pipe near the intake openings between the fingers inhibits frost formation. The sleeve for the vent pipe has an outward extension collar which can receive an extension pipe to assure clearance of any overhangs that may be present.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
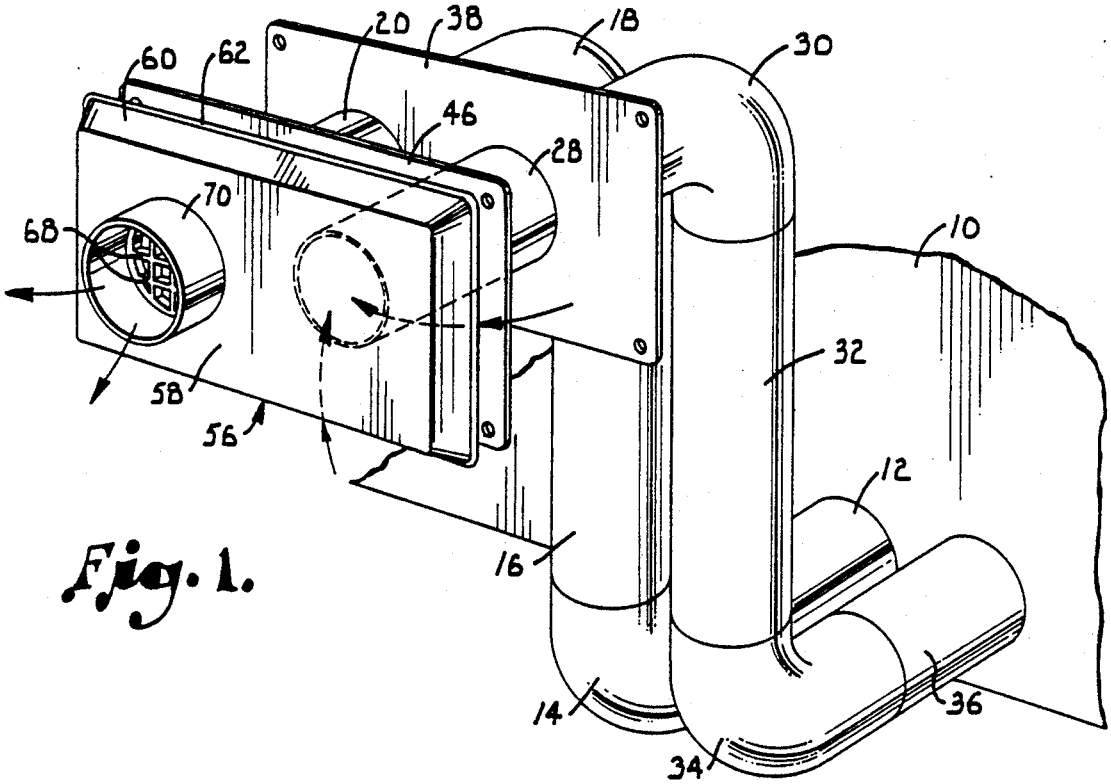
FIG. 1 is a fragmentary perspective view depicting exemplary vent and air supply pipes of a boiler equipped with a side wall termination unit constructed according to a preferred embodiment of the present invention, with the directional arrows indicating the flow pattern for the two pipes.
Figure 3:
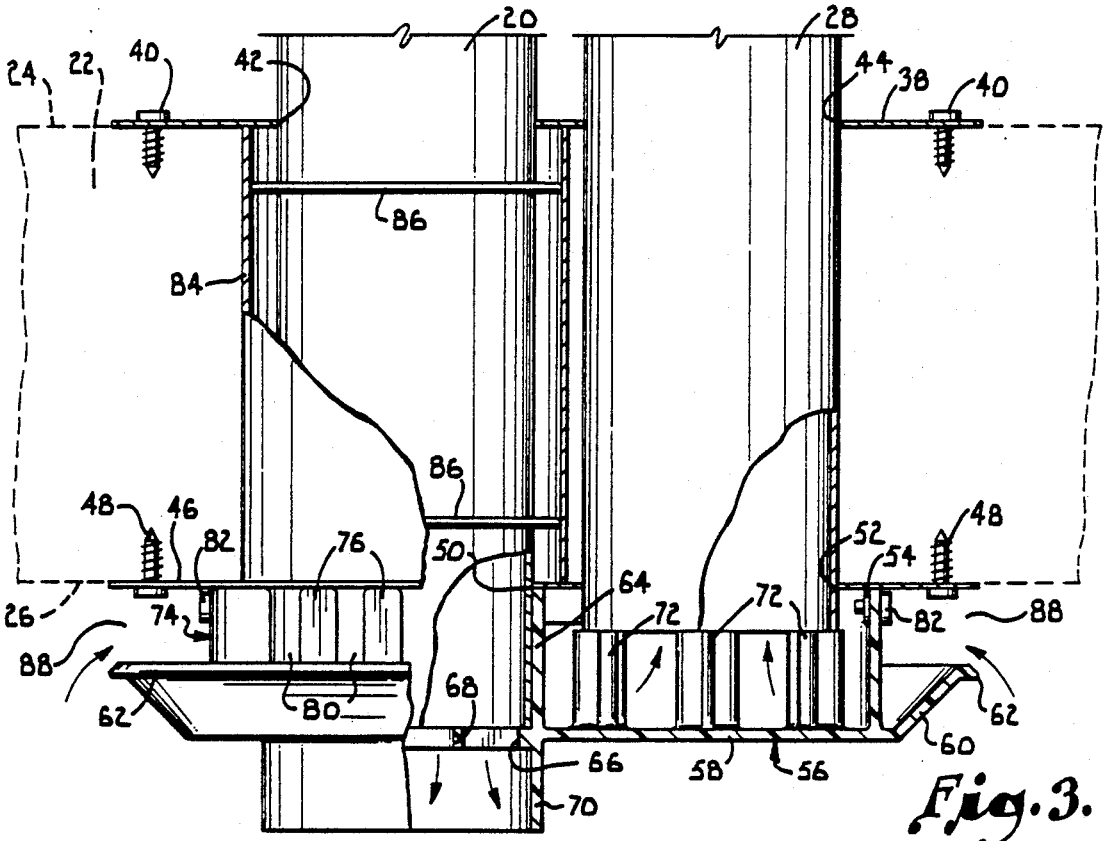
FIG. 3 is a fragmentary top plan view showing the termination unit installed on the side wall, with the side wall shown in broken lines and portions broken away for purposes of illustration.

Referring now to the drawings in more detail and initially to FIG. 1, numeral 10 designates a gas fired boiler which may be constructed in any suitable manner. The combustion gases generated in the boiler 10 are vented through a vent piping system which includes a pipe 12 extending through a panel of the boiler and connected by an elbow 14 with a vertical pipe 16. The pipe 16 is in turn connected through another elbow 18 with a generally horizontal vent pipe 20. As best shown in FIG. 3, the vent pipe 20 extends through a wall 22 of the building in which the boiler 10 is contained. The wall 22 may be constructed in any suitable manner and presents an interior surface 24 and an exterior surface 26.

Combustion air is supplied to the boiler 10 through an air supply piping system which includes a generally horizontal pipe 28 extending through the wall 22 at a location to one side of pipe 20. Pipe 28 is connected by an elbow 30 with a vertical pipe 32 which in turn connects with an elbow 34. Connected with the elbow 34 is another pipe 36 which extends through a panel of the boiler 10 to the combustion system of the boiler.

It should be noted that the vent piping and the air supply piping can have virtually any configuration and that the configurations shown in FIG. 1 are for purposes of illustration only. It should also be noted that the two piping systems are separate from one another and extend in a generally side by side arrangement. Consequently, the piping for the air supply system can be constructed of a variety of materials, including flexible drier vent ducting, polyvinyl chloride, and galvanized steel. The components of the vent piping should be constructed of stainless steel or another material suitable for the handling of hot exhaust gases.

The present invention is directed to a termination unit for terminating the vent and air pipes at the side wall 22. A flat metal interior plate 38 may be constructed of aluminum or any other suitable material. The plate 38 is secured to the interior wall surface 34 by suitable fasteners such as the screws 40 shown in FIG. 3. Plate 38 is provided with a vent opening 42 through which pipe 20 extends and another opening 44 through which pipe 28 extends. The openings 42 and 44 are arranged side by side on plate 38 to accommodate the side by side pipes 20 and 28. The pipes preferably fit closely through the openings 42 and 44. Plate 38 may be furnished with a knockout (not shown) initially covering the opening 44 so that it can be used to receive only the vent pipe 20 if outside air is not to be used for combustion.

An exterior plate 46 takes the form of a flat metal plate that may be constructed of stainless steel or another suitable material. Plate 46 is mounted against the exterior surface 26 of the wall 22 by fasteners such as the screws 48 (see FIG. 3). Plate 46 is provided with a vent opening 50 which aligns with opening 42 and which closely receives the vent pipe 20. To one side of opening 50 is another opening 52 which aligns with opening 44 and closely receives the air supply pipe 28. Opening 52 may be initially provided with a knockout which can remain in place if outside air for combustion is not desired. A plurality of tabs 54 are bent to extend outwardly from the exterior plate 46.

The major component of the termination unit is a termination cap which is generally identified by numeral 56 and which is preferably injection molded as a single integral piece constructed of high temperature plastic resin. The outer surface of the termination cap 56 is formed by a flat rectangular face plate 58. A peripheral flange 60 extends outwardly and rearwardly from the edges of the face plate 58 at an angle of approximately 45°. The flange 60 terminates in a free edge which is provided with a bead 62.

Figure 2:
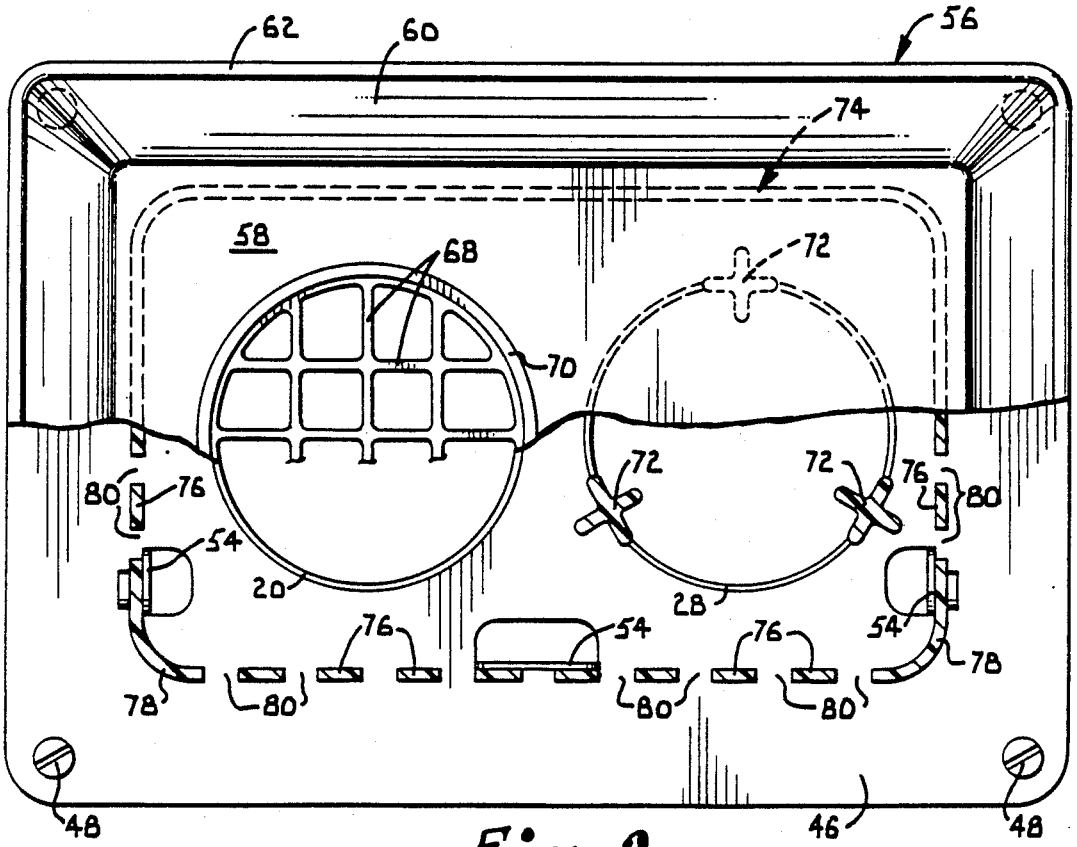
FIG. 2 is a front elevational view of the termination unit on an enlarged scale, with a portion broken away for purposes of illustration.

As shown particularly in FIG. 3, a cylindrical sleeve 64 extends inwardly from the inside surface of the face plate 58. The sleeve 64 extends inwardly well past the bead 62 of the flange 60 and has a diameter to closely receive the open end of the vent pipe 20. The face plate 58 is provided with a circular vent opening 66 which is aligned with the sleeve 64 and provided with a grill 68 (see FIGS. 1 and 2 in particular). A cylindrical collar 70 extends outwardly from the face plate 58 at a location aligned with the sleeve 64 such that the collar essentially forms an outward extension or continuation of the sleeve. The diameter of the collar 70 is the same as that of the sleeve 64.

Figure 4:
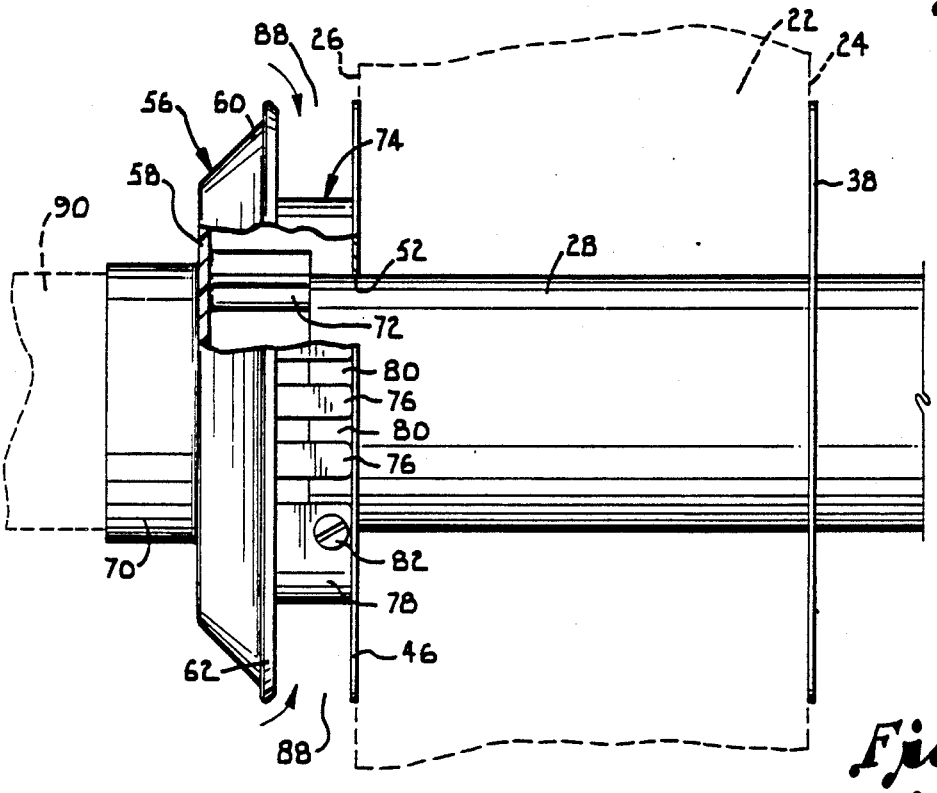
FIG. 4 is a side elevational view showing the termination unit mounted on the side wall, with the side wall shown in broken lines and portions broken away for purposes of illustration.

Extending rearwardly from the inside surface of the face plate 58 are three spaced apart stop elements 72. The stop elements 72 are located to one side of the sleeve 64 and may have an x-shaped configuration. The stop elements 72 are arranged to lie on a circle having the same diameter as that of the air supply pipe 28. Consequently, the open intake end of the air supply pipe 28 can be butted against the free ends of the stop elements 28, as best shown in FIGS. 3 and 4. The stop elements 72 do not extend as far inwardly as the sleeve 64.

Extending inwardly from the inside surface of the face plate 58 is a wall which is generally identified by numeral 74 and which is formed by a plurality of spaced apart fingers 76. The fingers 76 cooperate to provide the wall 74 with a generally rectangular configuration. Rounded corner pieces 78 are provided at the four corners of the wall 74. The wall 74 extends around the sleeve 64 and the stop elements 72 and projects from the face plate 58 the same distance as the sleeve 64. Because the fingers 76 are spaced apart from one another, they present spaces between them which form air intake openings 80 for supplying outside air to the air supply pipe 28. The termination cap 56 may be secured to the exterior mounting plate 46 by fasteners such as screws 82 which connect the wall 74 with the tabs 54 of the plate 46. The screws 82 may be extended through openings in the corner pieces 78 and threaded into openings in the tabs 54. The tabs 54 fit closely against the inside of the wall 74 in order to properly locate the cap 56 on plate 46. The free ends of the fingers 76 and sleeve 64 butt against plate 46 when the termination cap is in place.

The termination unit is installed by cutting suitable holes through the wall 22 for receiving the pipes 20 and 28. A galvanized steel sleeve 84 which is larger than the vent pipe 20 is mounted in the vent opening in the wall 22 and extends between the interior and exterior plates 38 and 46 in the manner shown in FIG. 3. A plurality of spacers 86 are installed between the sleeve 84 and the vent pipe 20 to hold the vent pipe concentrically within the larger sleeve 84. With the plates 38 and 46 mounted on the wall 22, the pipes 20 and 28 are extended through the corresponding openings. The vent pipe 20 is long enough to extend completely through the sleeve 64 to the plane of the face plate 28 such that its open end is adjacent to the vent opening 66 (see FIG. 3). The air supply pipe 28 does not extend as far outwardly as the vent pipe 20 and terminates such that its open end butts against the stop elements 72 at locations spaced inwardly from the plane of the face plate 58. This maintains the open intake end of pipe 28 at an exposed position so that it can receive incoming combustion air. The termination cap 58 is mounted to the exterior plate 46, and it is noted that the bead 62 is spaced well outwardly from the exterior wall surface 26 and the plate 46 to present an air intake slot 88 around the entire perimeter of the termination cap. Preferably, the flange 60 extends outwardly far enough to cover the mounting plate 46 such that only the relatively attractive termination cap 56 is noticeable.

In operation, the exhaust gases from the boiler are vented through the vent piping and pass from pipe 20 through the vent opening 66 to the outside of the building. If an eave or other overhang is located above the termination cap 56, it may be desirable to extend the vent piping outwardly. In this situation, an additional extension pipe such as the pipe 90 depicted in broken lines in FIG. 4 can be fitted in the collar 70, with the pipe 90 extending outwardly far enough to clear the overhang and thus prevent problems in the venting of the combustion gases.

Outside combustion air is drawn into the boiler through a draft which is created to directly pull outside air through the slot 88 and then through the intake openings 80 into the open end of the air intake pipe 28. The air then flows through the air supply piping and into the boiler to provide the air used in the combustion process.

Although the termination cap 56 is illustrated as being installed in a horizontal orientation, the vent and air pipes can be arranged one above the other and the cap 56 can then be installed vertically to accommodate the piping installation.

Because of the side by side (or one above the other) arrangement of the air and vent pipes, the bending radii that are required for turns in the piping are decreased in comparison to a concentric piping arrangement. Additionally, there is no need for an inner plenum in the boiler to provide a transition of the type required for concentric piping systems. Relatively long piping runs are possible with side by side piping systems.

It is noted that the intake openings 80 are provided around all sides of the air intake pipe 28. Consequently, in the event of frost which may clog some of the openings 80, other of the openings 80 will remain open to assure an adequate supply of combustion air. It is also noted that the vent pipe 20 is located in close proximity to the intake openings 80 such that the heat from the vent pipe impedes the formation of frost that can clog the air intake openings 80. The one piece termination cap 56 is preferably constructed from high temperature plastic resin which is resistant to damage caused by acidic condensates in the flue products and other chemical agents that may be present.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without department from the scope thereof, it is to be understood that all matter herein set forth or shown in the accompanying drawings is to be interpreted as illustrative and not in a limiting sense.

Having thus described the invention, what is claimed is:

1. A side wall vent/air termination unit for separate vent and air supply pipes of a boiler, said termination unit comprising:

a termination cap having first and second portions for receiving ends of the vent pipe and air supply pipe, respectively, when the pipes are extended through the side wall;

means for mounting said termination cap on said side wall on an exterior surface thereof;

a face plate on said termination cap at an exposed location spaced outwardly from said exterior surface when the termination cap is mounted on the side wall;

said face plate having a vent opening therethrough aligned with said vent pipe to vent through the face plate exhaust gases from the boiler which flow through the vent pipe;

said termination cap having a termination cap wall which extends around said first and second portions and within which the end of the air supply pipe is situated with said end of the supply pipe exposed to receive incoming air; and a plurality of air intake openings in said termination cap wall for receiving incoming air supplied to the supply pipe.

2. The termination unit of claim 1, wherein said termination cap includes:

a peripheral flange on said face plate terminating in a free edge spaced from said exterior surface when the cap is mounted thereon to accommodate passage of air past said free edge to said intake openings.

3. The termination unit of claim 1, wherein said first portion includes a sleeve extending from said face plate at a location within said termination cap wall and aligned with the vent opening.

4. The termination unit of claim 3, including a collar projecting outwardly from said face plate at a location aligned with the sleeve to provide an outward extension thereof.

5. The termination unit of claim 3, wherein said second portion includes a plurality of stop elements projecting inwardly from said face plate at a location to one side of said sleeve and spaced apart from one another to engage the end of the air supply pipe.

6. The termination unit of claim 1, wherein said mounting means for the termination cap comprises:

an exterior plate having openings for receiving the vent and air supply pipes;

means for securing said plate to said exterior surface of the side wall; and means for fastening said termination cap to said plate.

7. The termination unit of claim 6, including:

an interior plate having openings for receiving the vent and air supply pipes; and means for securing said interior plate to an interior surface of the side wall.

8. A side wall vent/air termination unit for side by side vent and air supply pipes of a boiler, said termination unit comprising:

a termination cap adapted to be mounted to an exterior surface of the side wall and having a face plate and a peripheral flange extending from the face plate, said flange terminating in a free edge spaced outwardly from said exterior side wall surface when the termination cap is mounted thereon to present an air intake slot between said exterior side wall surface and said free edge of said flange;

a termination cap wall extending from said face plate and terminating adjacent said exterior surface when the termination cap is mounted thereon;

a sleeve extending inwardly from the face plate at a location within said termination cap wall for receiving the end of the vent pipe, said face plate having a vent opening therethrough at a location aligned with said sleeve to vent exhaust gases from the end of the vent pipe through said vent openings;

means located beside said sleeve for receiving the end of the air supply pipe at a location within said termination cap wall and spaced inwardly from the face plate to maintain the end of the supply pipe exposed for the receipt of incoming air to be supplied to the boiler; and a plurality of intake openings in said termination cap wall for admitting air flowing past the free edge of said flange to the air supply pipe.

9. The termination unit of claim 8, wherein said face plate, flange, termination cap wall and sleeve are molded integrally with one another.

10. The termination unit of claim 8, wherein said means located beside said sleeve comprises a plurality of stop elements projecting inwardly from said face plate at a location to one side of said sleeve and spaced apart from one another to engage the end of the air supply pipe.

11. The termination unit of claim 8, including a collar projecting outwardly from said face plate at a location aligned with the sleeve and vent opening to direct the exhaust gases outwardly beyond its face plate.

12. The termination unit of claim 11, including a grill in said vent opening.

13. The termination unit of claim 8, including:

an exterior plate having openings for receiving the vent and air supply pipes;

means for securing said plate to said exterior surface of the side wall; and means for fastening said termination cap to said plate.

14. The termination unit of claim 13, including:

an interior plate having openings for receiving the vent and air supply pipes; and means for securing said interior plate to an interior surface of the side wall.

15. The termination unit of claim 8, including:

an interior plate having openings for receiving the vent and air supply pipes; and means for securing said interior plate to an interior surface of the side wall.

16. In a vent and combustion air supply system for a boiler having side by side vent and air supply pipes extending from the boiler through a side wall of a building containing the boiler, the improvement comprising:

an interior plate adapted for mounting on an interior surface of the side wall and having side by side openings for receiving the vent and air supply pipes;

an exterior plate adapted for mounting on an exterior surface of the side wall and having side by side openings for receiving the vent and air supply pipes;

a termination cap having a face plate and a peripheral flange on said face plate terminating in a free edge, said cap having a perforated wall extending from the face plate at a location inside of said flange and said cap being adapted for connection to said exterior plate with said flange substantially covering the exterior plate and said free edge spaced outwardly of the exterior plate to expose the perforated wall to outside air; and means within said perforated wall for receiving the ends of the vent and air supply pipes side by side with the end of the air supply pipe spaced from the face plate and exposed to receive air passing through the perforated wall, said face plate presenting a vent opening therethrough at a location adjacent to and aligned with the end of the vent pipe to vent to the outside exhaust gases through said vent opening and outwardly of the face plate.

17. The improvement of claim 16, wherein said means within said wall comprises a sleeve extending from the face plate for receiving the end of the vent pipe, said sleeve being aligned with said vent opening.

* * * * *